US006491506B1

(12) United States Patent
Oh et al.

(10) Patent No.: US 6,491,506 B1
(45) Date of Patent: Dec. 10, 2002

(54) LINEAR COMPRESSOR

(75) Inventors: Won Sik Oh, Seoul (KR); Jung Sik Park, Seoul (KR); Kyung Bum Hur, Seoul (KR); Gye Young Song, Kwangmyung (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/693,857

(22) Filed: Oct. 23, 2000

(30) Foreign Application Priority Data

May 29, 2000 (KR) ..... 2000/29043
Jun. 1, 2000 (KR) ..... 2000-30041

(51) Int. Cl.[7] ..... F04B 17/04
(52) U.S. Cl. ..... 417/417; 417/406; 92/186
(58) Field of Search ..... 417/416, 417; 92/186

(56) References Cited

U.S. PATENT DOCUMENTS 5,993,178 A * 11/1999 Park et al. ..... 417/545
6,024,544 A * 2/2000 Kim et al. ..... 417/417
6,077,054 A * 6/2000 Lee et al. ..... 417/417
6,089,836 A * 7/2000 Seo ..... 417/417
6,152,710 A * 11/2000 Oh et al. ..... 417/570
6,174,141 B1 * 1/2001 Song et al. ..... 417/312
6,202,791 B1 * 3/2001 Oh et al. ..... 184/6.16
6,231,310 B1 * 5/2001 Tojo et al. ..... 417/44.1

* cited by examiner

*Primary Examiner*—Timothy S. Thorpe
*Assistant Examiner*—William H. Rodriguez
(74) *Attorney, Agent, or Firm*—Birch, Stewart, Kolasch & Birch, LLP

(57) ABSTRACT

A linear compressor includes a casing having a suction pipe and a discharge pipe and a unit including a cylinder formed therein and an inner stator assembly and an outer stator assembly installed on the exterior of the cylinder and a magnet assembly inserted into the certain void of the inner and outer stator assembly for performing a reciprocating motion linearly and a piston connected to the magnet assembly by forming a connection portion and a gas through hole formed in the connection portion of the magnet assembly and piston, which is capable of decreasing a flow resistance by forming the gas through holes in the connection portion of the magnet assembly and the piston and decreasing the specific volume of the suction coolant by making the coolant gas filled the both area of the connection portion flow reciprocally in the reciprocating motion of the piston.

10 Claims, 6 Drawing Sheets

LINEAR COMPRESSOR

BACKGROUND OF THE INVENTION

1. Field of the Invention

The present invention relates to a linear compressor, and in particular to a linear compressor which is capable of improving efficiency of the compressor by minimizing flow channel resistance generated in a reciprocating motion of a piston.

2. Description of the Prior Art

In general, in a linear compressor compressing fluid such as air or coolant gas, linear driving force of a motor is transmitted to a piston, and the piston sucks and compresses the coolant gas by performing a linear reciprocating motion.

Hereinafter, the conventional linear compressor will now be described.

As depicted in FIG.1~FIG.3, the conventional linear compressor comprises a casing V having a certain amount of oil at the inner bottom surface, a compression unit C installed horizontally inside of the casing V for compressing and discharging the coolant after sucking, and an oil feeder O fixed on the external of the compression unit C for providing oil to a sliding portion.

The compression unit C comprises a frame 1 having a ring shape, a cover 2 fixedly installed on the side of the frame 1, a cylinder 3 fixed horizontally on the center of the frame 1, an inner stator assembly 4*a* fixed on the. outer circumference of the frame 1 supporting the cylinder 3, an outer stator assembly 4*b* fixed on the outer circumference of the inner stator assembly 4*a* with a certain void, a magnet assembly 5 interposed on the void between the inner and outer stator assembly 4*a*, 4*b*, a piston 6 connected to the magnet assembly 5 for sucking and compressing the coolant gas by performing a sliding motion inside of the cylinder 3, an inner and outer resonance spring 7*a*, 7*b* for inducing the magnet assembly 5 to perform a resonance motion continually at the void between the inner and outer stator assembly 4*a*, 4*b*, and a discharge valve assembly 8 installed on the front end of the cylinder 3 for controlling discharge of a compressed gas in the reciprocating motion of the piston 6.

The piston 6 includes a body portion 6*a* having a certain length, a head portion 6*b* having a disk flange shape connected to the magnet assembly 5 formed on the rear portion of the body portion 6*a*, and a gas flow channel F formed on the center of the body portion 6*a* for guiding the coolant gas to the cylinder 3.

A curved portion 5*a* is formed on the magnet assembly 5 having a disk shape in order to be connected to the head portion of the piston 6.

A non-described reference numeral 9 is a suction valve, SP is a suction pipe, and a VP is a discharge pipe.

The operation of the conventional linear compressor will now be described.

Current is applied to the inner and outer stator assembly 4*a*, 4*b*, the magnet assembly 5 performs the linear reciprocating motion, the piston 6 connected to the magnet assembly 5 performs the reciprocating motion linearly inside of the cylinder 3, pressure difference occurs inside of the cylinder 3, the coolant gas inside of the casing V is sucked into the cylinder 3 through the gas flow channel F of the piston 6 by the pressure difference inside of the cylinder 3, is compressed, and is discharged. The above-described operation is performed repeatedly.

Herein, part of the coolant gas sucked in the suction process of the piston 6 through the suction pipe SP flows to inner side of the cover 2 in the reciprocating motion of the piston 6, the part of the coolant gas flows again inside of the magnet assembly 5 through the void of the inner and outer stator assembly 4*a*, 4*b*, accordingly the coolant is evenly distributed all over the casing V.

However, in the conventional linear compressor, the coolant gas fills generally the connection portion of the magnet assembly 5 and piston 6, namely, the curved portion 5*a* of the magnet assembly 5 and head portion 6*a* of the piston 6, however the connection portion of the magnet assembly 5 and piston 6 seems to be blocked, accordingly flow resistance of the fluid occurs in the reciprocating motion of the piston and the efficiency of the compressor lowers.

SUMMARY OF THE INVENTION

It is an object of the present invention to provide a linear compressor which is capable of minimizing a flow resistance of fluid occurred in a reciprocating motion of the piston.

To achieve the object, a linear compressor of the present invention including a casing filled with oil at the bottom surface having a suction pipe and a discharge pipe, a unit elastically supported so as to be horizontally excited minutely inside of the casing including a cylinder formed on the inner center, an oil feeder installed on the bottom surface of the unit sunk under the oil for providing oil to the unit, an inner and outer stator assembly installed on the external of the cylinder so as to have a certain void between each other, a magnet assembly inserted into the certain void of the inner and outer stator assembly for performing a reciprocating motion linearly, a piston connected to the magnet assembly for performing the linear reciprocating motion inside of the cylinder in accordance with the linear reciprocating motion of the magnet assembly, an inner and outer resonance spring installed between the cylinder and unit for inducing the magnet assembly to perform a resonance motion continually between the inner and outer stator assembly, and a discharge valve assembly combined to the front end of the cylinder and connected to a discharge pipe of the casing for controlling discharge of the compressed gas in the reciprocating motion of the piston, comprises a gas through hole formed on the connection portion of the magnet assembly and piston formed so as to be square with the direction of the reciprocating motion of the magnet assembly and piston in order to decrease the flow resistance due to the coolant gas occurred in the reciprocating motion of the magnet assembly and piston.

In addition, in the linear compressor of the present invention, a gas through hole is formed on the side wall surface of the magnet assembly in order to decrease the flow resistance occurred in the reciprocating motion of the piston due to the coolant gas.

In addition, in the linear compressor of the present invention, a plurality of gas through holes having a ring shape are formed and are zigzag-arrayed along the outer circumference of the sidewall of the magnet assembly.

DETAILED DESCRIPTION OF THE PREFERRED EMBODIMENTS

The present invention will now be described in detail with reference to the accompanying drawings.

Figure 1:
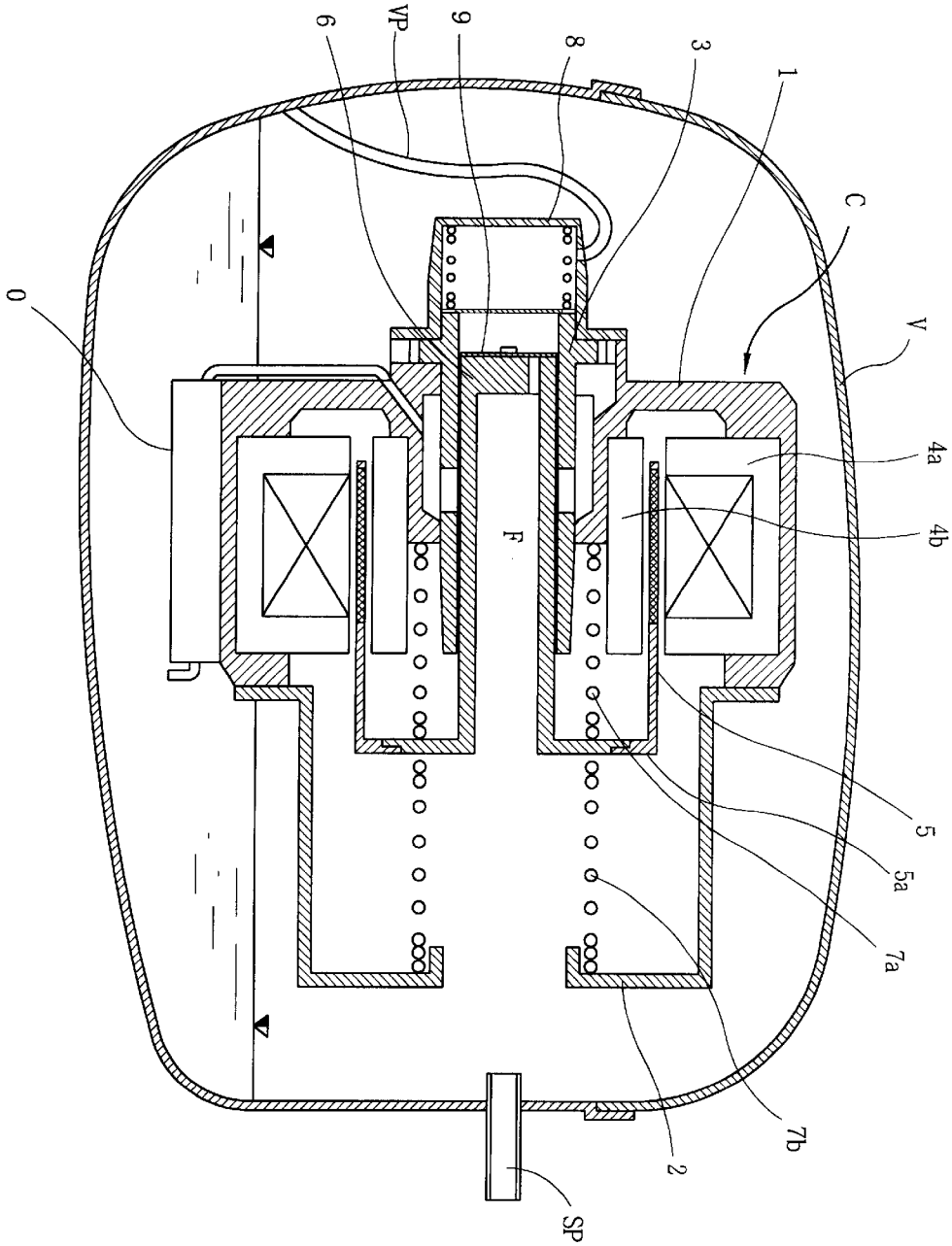
FIG. 1 BACKGROUND ART
FIG. 1 is a schematic sectional view illustrating a linear compressor according to the conventional technology.
Figure 2:
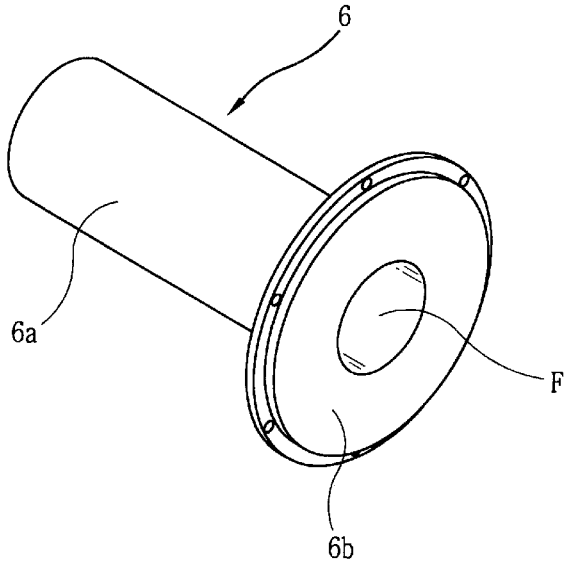
FIG. 2 BACKGROUND ART
FIG. 2 is a perspective view illustrating a piston of the conventional linear compressor.
Figure 3:
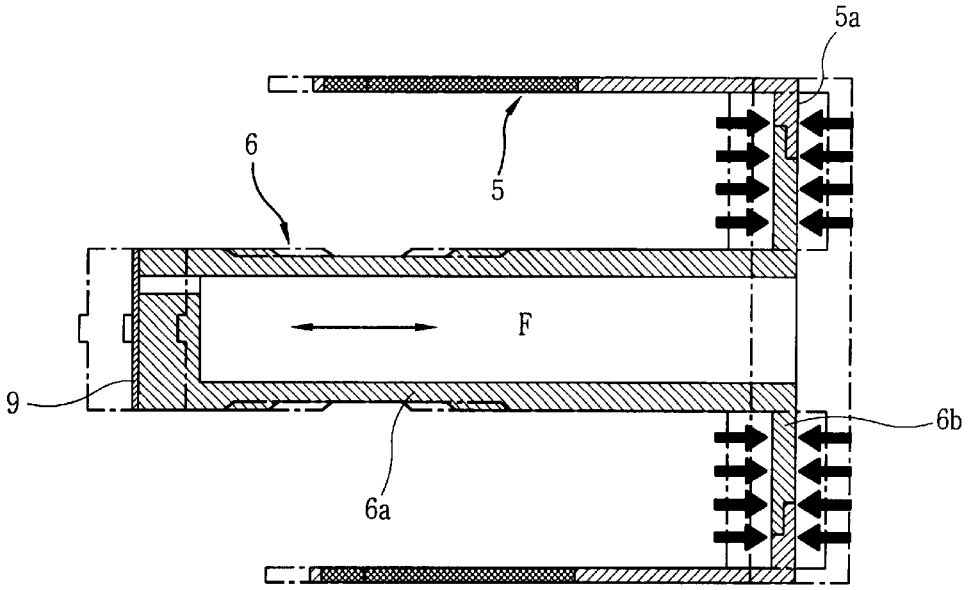
FIG. 3 BACKGROUND ART
FIG. 3 is a sketch illustrating flow resistance on connection portion of a magnet assembly and a piston in a reciprocating motion of the piston.
Figure 4:
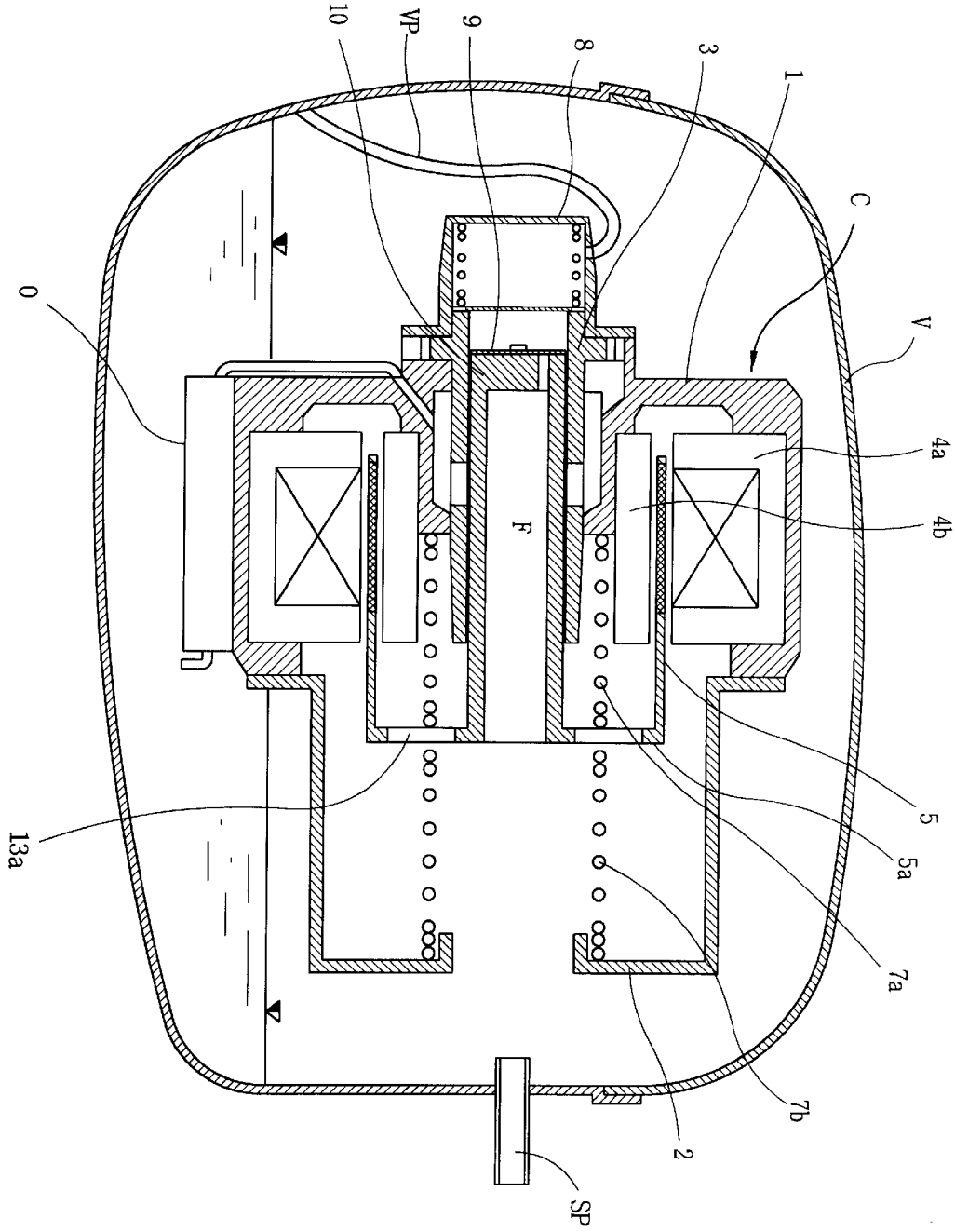
FIG. 4 is a schematic sectional view illustrating a linear compressor according to the present invention.
Figure 5:
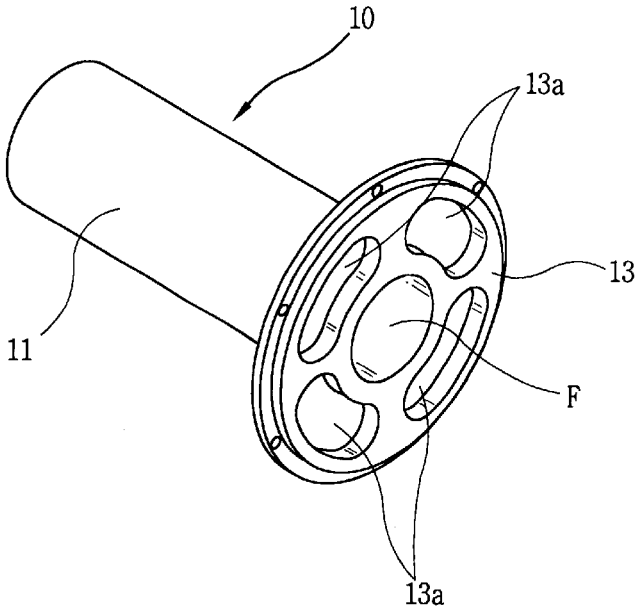
FIG. 5 is a perspective view illustrating a piston of the linear compressor of the present invention.
Figure 6:
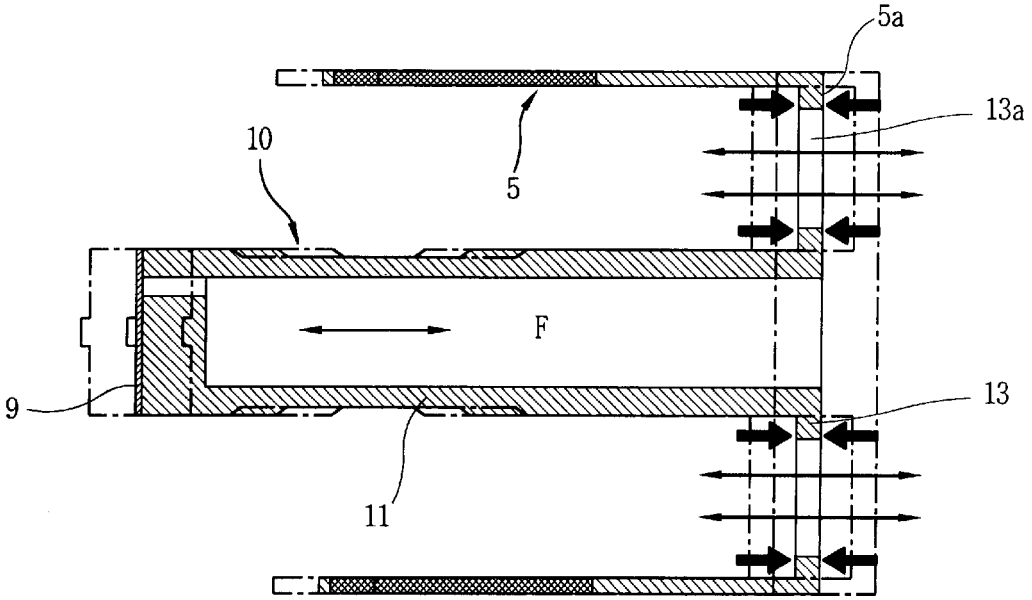
FIG. 6 is a sketch illustrating a flow resistance lowering state on connection portion of a magnet assembly and a piston in a reciprocating motion of the piston of the present invention.

As depicted in FIG. 4–FIG. 6, a linear compressor having a windage loss lowering structure of the present invention comprises a casing V filled with oil at the bottom surface having a certain internal volume including a suction pipe SP and a discharge pipe VP, a frame 1 having a ring shape elastically supported by the casing V, a cover having a hollow cylindrical shape fixed on the rear side surface of the frame 1, a cylinder 3 fixed horizontally on the center of the frame 1, an inner stator assembly 4*a* fixed on the outer circumference surface of the cylinder 3, an outer stator assembly 4*b* fixed on the outer circumference surface of the inner stator assembly 4*a* with a certain void, a magnetron assembly 5 interposed on the void between the inner stator assembly 4*a* and outer stator assembly 4*b* and performing a linear reciprocating motion, a piston 10 fixed on the magnet assembly 5 as one-body sliding-inserted into the cylinder 3 for performing the linear reciprocating motion with the magnet assembly 5 and compressing fluid after suctioning the fluid flowed to the casing V through a suction valve SP into the cylinder 3, an inner and outer resonance spring 7*a*, 7*b* elastically supporting for inducing the reciprocating motion of the piston 10 and magnet assembly 5, and a discharge valve assembly 8 installed on the front end of the cylinder 3 for restricting discharge of the coolant gas.

The piston 10 includes a body portion 11 having a certain length, a head portion 13 having a disk flange shape connected to a curved portion 5*a* of the magnet assembly 5 formed on the side of the body portion 11, and a gas flow channel F formed on the center of the body portion 11 for guiding the coolant gas to the cylinder 3.

As described above, the head portion 13 is formed as the disk flange shape, and a plurality of gas through holes 13*a* are formed on the same circumference of the head portion or on the lattice. The gas through holes 13*a* can be formed various shapes such as a circular arc shape of the present invention, or a ring shape.

In the accompanying drawings, the reference numeral same with the conventional technology will be abridged.

A non-described reference numeral 9 is a suction valve, SP is a suction pipe, and a VP is a discharge pipe.

The general operation of the linear compressor of the present invention Is similar to the conventional technology.

Current is applied to the inner and outer stator assembly 4*a*, 4*b*, the magnet assembly 5 performs the linear reciprocating motion, the piston 10 connected to the magnet assembly 5 performs the reciprocating motion linearly inside of the cylinder 3, pressure difference occurs inside of the cylinder 3, the coolant gas inside of the casing V is sucked into the cylinder 3 through the gas flow channel F by the pressure difference inside of the cylinder 3, is compressed, and is discharged. The above operation is performed repeatedly.

Herein, in the reciprocating motion of the piston 10, part of the coolant gas flows inside of the cover 2, the part of the coolant gas flows again inside of the magnet assembly 5 through the void between the inner and outer stator assembly 4*a*, 4*b* and magnet assembly 5, accordingly the coolant is distributed to the both sides of the connection portion, namely, the head portion 13 of the piston 10 and curved portion 5*a* of the magnet assembly 5.

Herein, when the piston 10 performs the linear reciprocating motion, the coolant filled the both sides of the connection portion of the piston 10 and the magnet assembly 5 causes the flow resistance by being pressed by the connection portion, however the coolant on the both connection portion is transferred each other by the gas through holes 13*a* formed on the head portion 13 of the piston 10, accordingly the flow resistance decreases and the efficiency of the compressor can be improved.

In addition, convection heat transmission is generated by the coolant gas circulating through the gas through holes 13*a* and it discharges heat of the piston 10, accordingly specific volume of the suction coolant decreases and efficiency of the compressor can be improved.

Figure 7:
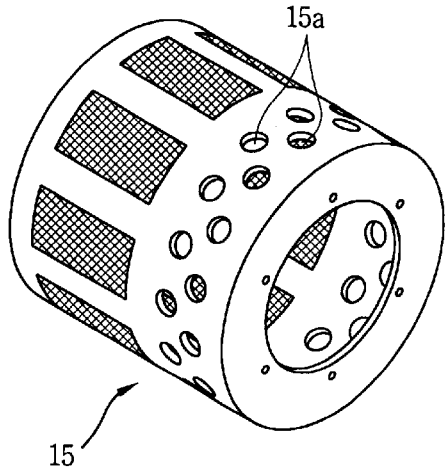
FIG. 7 FIG. 8 and FIG. 9 are perspective views illustrating a magnetic assembly according to embodiments of flow resistance lowering structure of the present invention.
Figure 8:
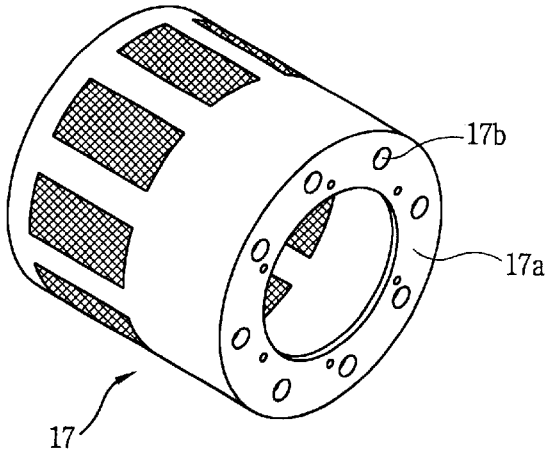
Figure 9:
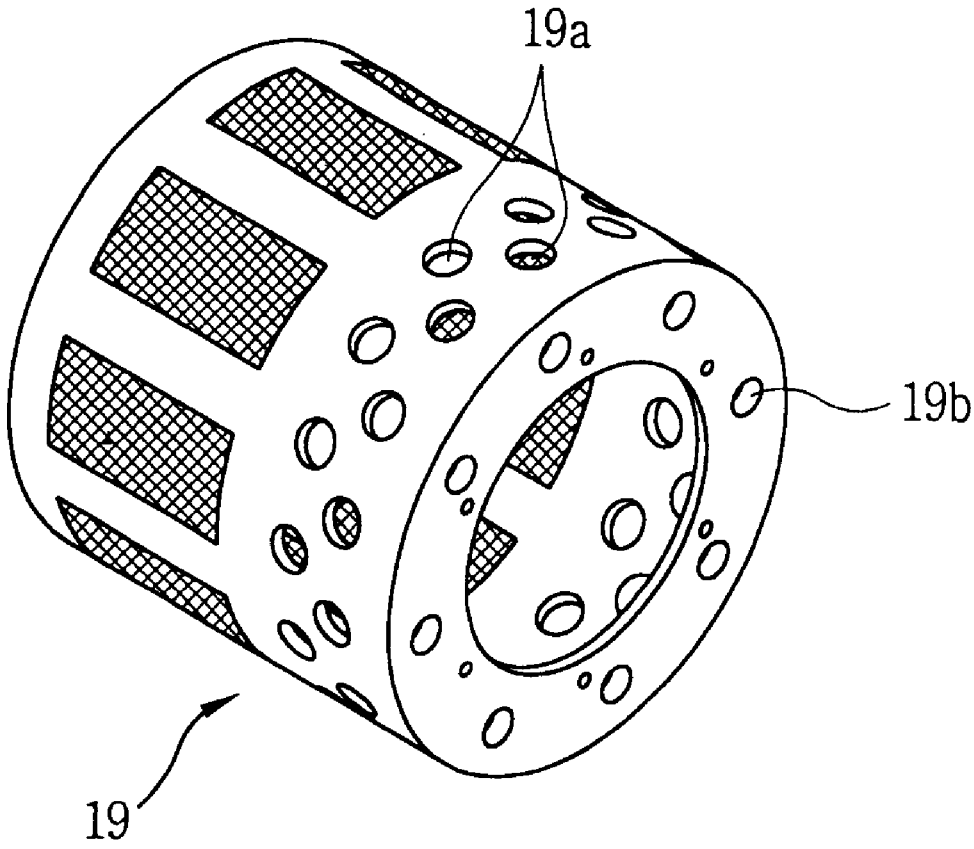

Meanwhile, FIG. 7~FIG. 9 illustrate the embodiments of the linear compressor of the present invention. FIG. 7 illustrates a plurality of gas through holes 15*a* having a ring shape formed and zigzag-arrayed on the certain portion of the outer circumference of the magnet assembly 15, FIG. 8 illustrates a plurality of gas through holes 17*b* having a ring shape formed on the curved portion 17*a* of the magnet assembly 17 combined to the head portion 13 of the piston 10, and FIG. 9 illustrates a plurality of gas through holes 19*a*, 19*b* having a ring shape formed on the certain portion of the outer circumference and curved portion of the magnet assembly 19.

As described above, the linear compressor of the present invention can decrease the flow resistance by forming the gas through holes on the connection portion of the magnet assembly and piston and making the coolant gas filled the both area of the connection portion flow reciprocally in the reciprocating motion of the piston. In addition, the piston can discharge the heat by the convention heat transmission generated by the coolant gas circulating through the gas through holes, accordingly specific volume of the suction coolant decreases and efficiency of the compressor can be improved.

What is claimed is:

1. A linear compressor, comprising:

a magnetic assembly interposed in a void between an inner and outer stator assembly and performing a linear reciprocating motion;

a piston connected to the magnet assembly for performing a linear reciprocating motion inside of a cylinder in accordance with the linear reciprocating motion of the magnet assembly; and a gas through path formed in the piston in order to decrease a flow resistance occurring during reciprocating motion of the piston due to coolant gas around the piston and magnet assembly, wherein said gas through path includes a plurality of gas through holes formed in a portion of the piston having a disk flange shape connected with the magnet assembly.

2. A linear compressor, comprising:

a magnet assembly interposed in a void between an inner and outer stator assembly and performing a linear reciprocating motion;

a piston connected to the magnet assembly for performing a linear reciprocating motion inside of a cylinder in accordance with the linear reciprocating motion of the magnet assembly; and a gas through path formed in the magnet assembly in order to decrease a flow resistance occurring during reciprocating motion of the magnet assembly due to coolant gas around the piston and magnet assembly.

3. The linear compressor according to claim 2, wherein said gas through path includes a plurality of gas through holes formed in a portion of the magnet assembly connected with the piston.

4. The linear compressor according to claim 2, wherein said gas through path includes a plurality of gas through holes circumferentially formed in a cylindrical portion of the magnet assembly.

5. The linear compressor according to claim 2, wherein said gas through path includes a plurality of gas through holes formed in a portion of the magnet assembly connected with the piston, and said gas through path also includes a plurality of gas through holes circumferentially formed in a cylindrical portion of the magnet assembly.

6. A linear compressor, comprising:

a magnet assembly interposed in a void between an inner and outer stator assembly and performing a linear reciprocating motion;

a piston connected to the magnet assembly for performing a linear reciprocating motion inside of a cylinder in accordance with the linear reciprocating motion of the magnet assembly; and a gas through path formed in the piston and the magnet assembly in order to decrease a flow resistance occurring during reciprocating motion of the piston and magnet assembly due to coolant gas around the piston and magnet assembly.

7. The linear compressor according to claim 6, wherein said gas through path includes a plurality of gas through holes formed in a portion of the piston having a disk flange shape connected with the magnet assembly.

8. The linear compressor according to claim 6, wherein said gas path includes a plurality of gas through holes formed in a portion of the magnet assembly connected with the piston.

9. The linear compressor according to claim 6, wherein said gas through path includes a plurality of gas through holes circumferentially formed in a cylindrical portion of the magnet assembly.

10. The linear compressor according to claim 6, wherein said gas through path includes a plurality of gas through holes formed in a portion of the magnet assembly connected with the piston, and said gas through path also includes a plurality of gas through holes circumferentially formed in a cylindrical portion of the magnet assembly.

* * * * *